US008083603B2

(12) United States Patent
Namala et al.

(10) Patent No.: US 8,083,603 B2
(45) Date of Patent: Dec. 27, 2011

(54) BOWLING BUMPER SYSTEM AND METHOD OF USE AND INSTALLATION

(75) Inventors: Samuel R. Namala, Mechanicsville, VA (US); David A. McCall, Richmond, VA (US); Charles Anton Lee, Williamsburg, VA (US); Patrick J. Reitelbach, Bumpass, VA (US)

(73) Assignee: QUBICAAMF Worldwide LLC, Mechanicsville, VA (US)

( * ) Notice: Subject to any disclaimer, the term of this patent is extended or adjusted under 35 U.S.C. 154(b) by 0 days.

(21) Appl. No.: 12/263,686

(22) Filed: Nov. 3, 2008

(65) Prior Publication Data

US 2009/0124403 A1 May 14, 2009

Related U.S. Application Data

(60) Provisional application No. 60/986,813, filed on Nov. 9, 2007.

(51) Int. Cl.
*A63D 5/00* (2006.01)

(52) U.S. Cl. ..... 473/113; 473/55

(58) Field of Classification Search ..... 473/56, 473/113, 115

See application file for complete search history.

(56) References Cited

U.S. PATENT DOCUMENTS

| | | | | |
|---|---|---|---|---|
| 5,322,476 | A * | 6/1994 | Wortman | 473/113 |
| 5,681,224 | A * | 10/1997 | Higashi | 473/109 |
| 5,857,918 | A * | 1/1999 | Beene | 473/55 |
| 7,052,404 | B2 * | 5/2006 | Heddon | 473/113 |
| 2008/0085308 | A1 * | 4/2008 | Sherry | 424/464 |

* cited by examiner

*Primary Examiner* — William Pierce

(74) *Attorney, Agent, or Firm* — Andrew M. Calderon; Roberts Mlotkowski Safran & Cole, P.C.

(57) ABSTRACT

A bowling bumper system is provided. The bowling bumper system and more particularly an actuator or actuator assembly is decoupled from the bumpers, themselves, and configured to move the bumpers into an extended or retracted position.

12 Claims, 10 Drawing Sheets

BOWLING BUMPER SYSTEM AND METHOD OF USE AND INSTALLATION

CROSS REFERENCE TO RELATED APPLICATIONS

The present application claims priority to U.S. Provisional Application Ser. No. 60/986,813, filed on Nov. 9, 2007, the contents of which are incorporated by reference in its entirety herein.

FIELD OF THE INVENTION

The present invention relates to a bowling bumper system and more particularly to an actuating system which is decoupled from bowling bumpers and configured to move the bowling bumpers into an extended or retracted position.

BACKGROUND DESCRIPTION

Bowling alley bumper systems are designed to be used by children and/or the physically handicapped as well as others who lack the physical coordination or strength to bowl i.e., project a majority of balls over the length of the alley without the ball falling into one of the gutters. Bowling alley bumpers are mainly used in full sized application, but with the advent of arcade type bowling, bumper systems can also be used with smaller sized versions of a bowling alley.

SUMMARY OF THE INVENTION

In a first aspect of the invention, a bowling bumper system comprises an actuator configured to contact and move a bumper rail between a raised position and a lowered position. The actuator having a first bracket arm which contacts a portion of the bumper rail and which is configured to be decouplable from the portion when placing the bumper rail into the lowered position.

In embodiments, the actuator is an electrical linear actuator. The bumper system is fitted into a preexisting bowling lane. The actuator is mounted between stringers below a bowling lane. The first bracket is mounted to an extending and retracting arm of the actuator and in contact with the bumper arm. The first bracket is mounted or coupled to the extending and retracting arm. The portion is a bumper arm and the first bracket is devoid of a connection to the bumper arm. A second bracket is in contact with a bumper arm of a respective bumper rail. The first and second brackets operate in unison via a connection to a shaft extending a width of a bowling lane. A control system is provided for monitoring and controlling operations of the actuator. The control system deactivates the bowling bumper system when a pinspotter is in standby mode or non-operating mode. A limit switch is provided to limit extension and retraction of the bumper system. The first bracket is devoid of a connection to the bumper rail or the portion of the bumper rail which comprises a bumper arm. The bumper rail and bumper arm are seated within a trough in a retracted position. The bumper rail and the bumper arm are below or at a surface of a bowling lane in the retracted position. The bumper rail and the bumper arm do not interfere with a bowling ball rolling into a gutter when the bumper rail and the bumper arm are in the retracted position. The trough is positioned between a gutter and a bowling lane. A trough is provided for accommodating the bumper rail and the portion of the bumper rail. The trough has at least one slot for accommodating a bracket extending from the actuator and contacting the bumper arm in a decoupled manner.

In another aspect of the invention, a method of using a bumper system comprises lowering or retracting a bumper rail of a bumper system solely by its own weight and raising the bumper rail by use of an actuator.

In embodiments, bumper rail is retracted in a controlled manner by a decoupled member from the bumper rail. The actuator is a linear motor and the bumper rail is extended by activation of the linear motor.

In further aspects of the invention, a method of installing or retrofitting a bumper system comprises: removing a gutter system or portion thereof; mounting an actuator between two stringers of a bowling lane substantially in a location under where the gutter system was removed; extending the first bracket which is mounted to an extending and retracting arm of the actuator through a first slot on a first side of the bowling lane; placing a second bracket through a second slot on an opposing side of the bowling lane; making a non-coupled connection between the first bracket and the second bracket via a rotatable shaft extending under the bowling lane; aligning the first bracket and the second bracket with respective arms of the bumper rails such that the first bracket and the second bracket make physical contact with the respective arms; installing the gutter system or the portion thereof.

In further aspects of the invention, a bowling bumper system comprises an actuator having an extending and retracting arm. The system includes a shaft extending on an underside of a bowling lane between gutters and a first bracket coupled to the extending and retracting arm and to the shaft at a first side. A second bracket is coupled to the shaft on a second side, and is moveable when the extending and retracting arm moves the first bracket.

In embodiments, the system is fitted into a preexisting bowling lane. The actuator is mounted between stringers below the bowling lane. The first bracket and the second bracket are in contact with respective bumper arms on opposing sides of the bowling lane. The first bracket and the second bracket are both decouplable from the bumper arm. A control system is provided for monitoring and controlling operations of the actuator. A limit switch is provided to control a limit of extension and retraction of the actuator. The bumper rail and the bumper arm are below or at a surface of a bowling lane in the retracted position. The actuator includes an internal actuator thermal overload protection system.

BRIEF DESCRIPTION OF THE DRAWINGS

The present invention is described in the detailed description which follows, in reference to the noted plurality of drawings by way of non-limiting examples of exemplary embodiments of the present invention, in which.

DETAILED DESCRIPTION OF EMBODIMENTS OF THE INVENTION

Figure 1:
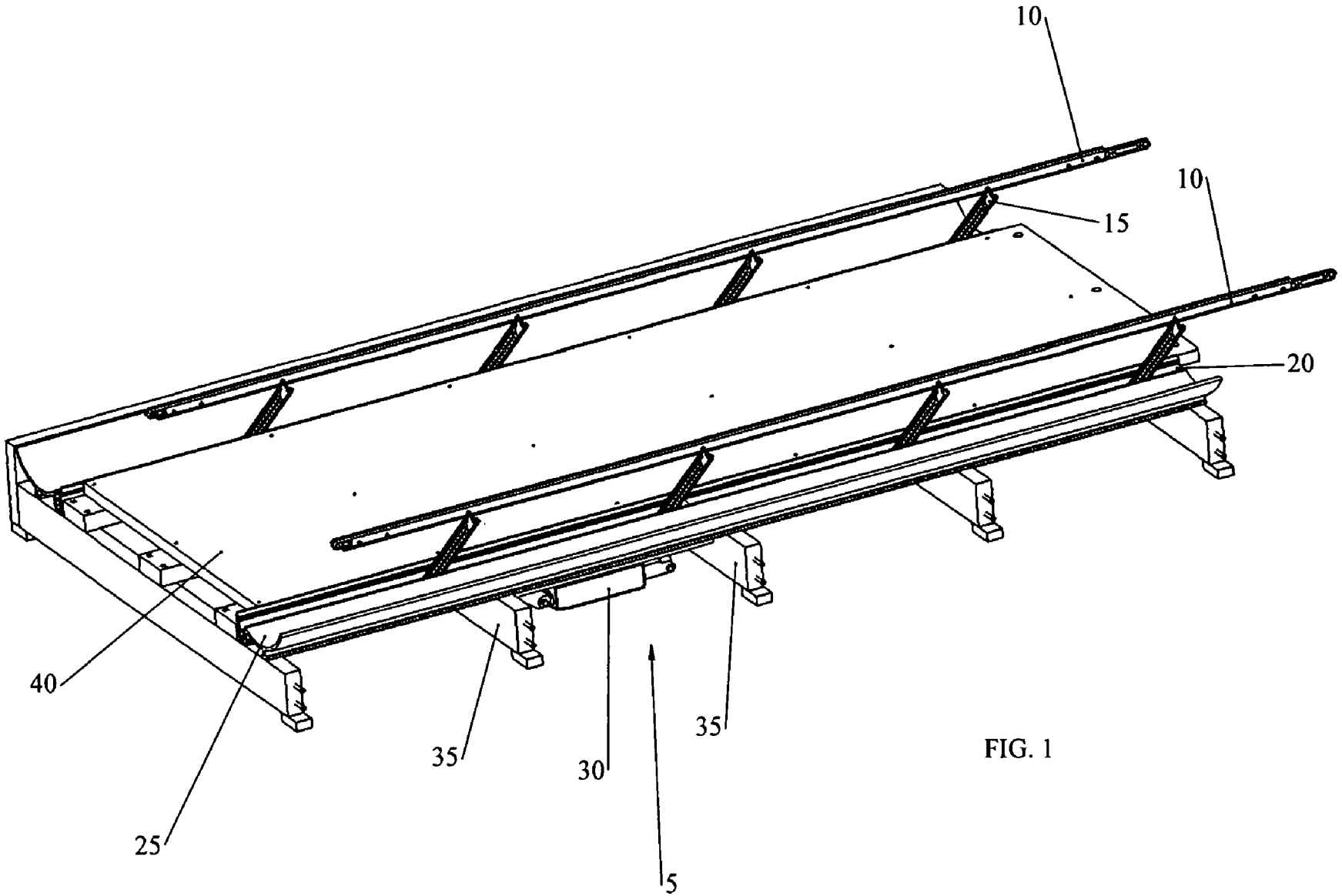
FIG. 1 shows a perspective view of the bumper system in an extended position in accordance with one aspect of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention relates to bowling bumper system and more particularly to a bowling bumper system which is decoupled from the bumpers, themselves, and configured to move the bumpers into an extended or retracted position. More particularly, the bowling bumper system includes an electrical linear actuator or other type of actuator (e.g., hydraulic or pneumatic) for an arcade style bowling lane, which is also adaptable to full sized bowling lanes. In one configuration, the entire mechanical design of the bowling bumper system fits between perpendicular (with respect to the lane panels) stringers of the bowling lane and vertically between the floor and the bottom of the gutter installation. In addition, the bowling bumper system is designed to be retrofitted into existing lane structures without any disassembly of the existing sub lane structure.

The actuator, itself, is situated under the gutter assemblies and is accessible with only the removal of the start gutter assembly, for example. Although the design contemplates the use of a single electrical or other type of actuator (hereinafter referred generally to as an "actuator") to activate both bumpers on a single lane using a connection extending under the sub lane, the present invention contemplates the use of more than one actuator depending on the size of the system and force exerted by the actuator. In other contemplated versions of the invention, a single actuator can be used to extend and control the retraction of bumpers (e.g., bumper rails) for two or more bowling lanes.

In embodiments, a bracket connects to an extending and retracting arm of the actuator. The bracket is decoupled from the bumper arm or bumper rail, itself. That is, the activation of the bumpers via the actuator is designed to push up on the lower edge of the bumper arm without being mechanically coupled to the bumper arm via fasteners. As there is no coupling between the bumper arm and the actuator (or bracket attached to the actuator), the bumper rail can be retracted through its own weight (gravity), alone. Also, the decoupling of the actuator from the bumper rail acts as a safety feature, e.g., if there is an object preventing normal operation of the bumper rails, the bracket coupled to the actuator shall retract without pulling on the bumper arm of the bumper rails. Using this method and system, the maximum force acting on the object preventing normal operation shall only be the weight of the bumper rails. After the potential for pinch has ended, the bumper rails will return to the retracted position under their own weight without the help of the system operator or the need for any actuator.

FIG. 1 shows a perspective view of the bumper system in an extended position in accordance with one aspect of the invention. As shown, the bumper system is shown generally as reference numeral 5. In FIG. 1, the bumper system 5 is in the upright or extended position. The bumper system 5 includes bumper rails 10 each pivotally connected to a plurality of bumper arms 15 (also referred to as crank arms). In the retracted position, the bumper rails 10 and bumper arms are seated within a trough or groove 20, located on an inner side of opposing gutters 25. An actuator 30 is positioned between stringers 35 of the bowling lane 40. As the actuator 30 is decoupled from the bumper rails 10 and more specifically decoupled from the bumper arms 15, the bumper rails can be lifted manually by a user (operator) or automatically by the actuator 30.

In one contemplated embodiment, the actuator can be an LA12 electrical actuator from Linak of Denmark. (Linak part number: LA 121000-10402420, with a 750N thrust capacity, 40 mm stroke.) Those of skill in the art will realize that other electrical actuators and other types of motors or actuators (generally referred to as an actuator) can also be used with the invention, depending on the application of the bumper system. Variables to consider in selecting a motor or actuator for the present invention include stroke length, thrust force, size and weight of the bumper system, etc. In embodiments, depending on the use and/or configuration of the actuator, the actuator can control two or more lanes of bumper rails with one actuator.

In embodiments, the direction of the actuator 30 can be controlled by using forward/reverse inputs dedicated to the actuator 30. In further embodiments, a limit switch can be used to adjust the stroke length of the actuator 30 and hence the extended height of the bumper rails 10. The limit switch is also designed to automatically shut down the actuator 30 at the fully extended position of the bumper rail 10 and fully retracted position of the actuator 30. The customer can activate the bumper system 5 using a switch, for example. Alternatively, the bumper system 5 can be controlled automatically using the scoring system of the bowling lane or other control.

Figure 2:
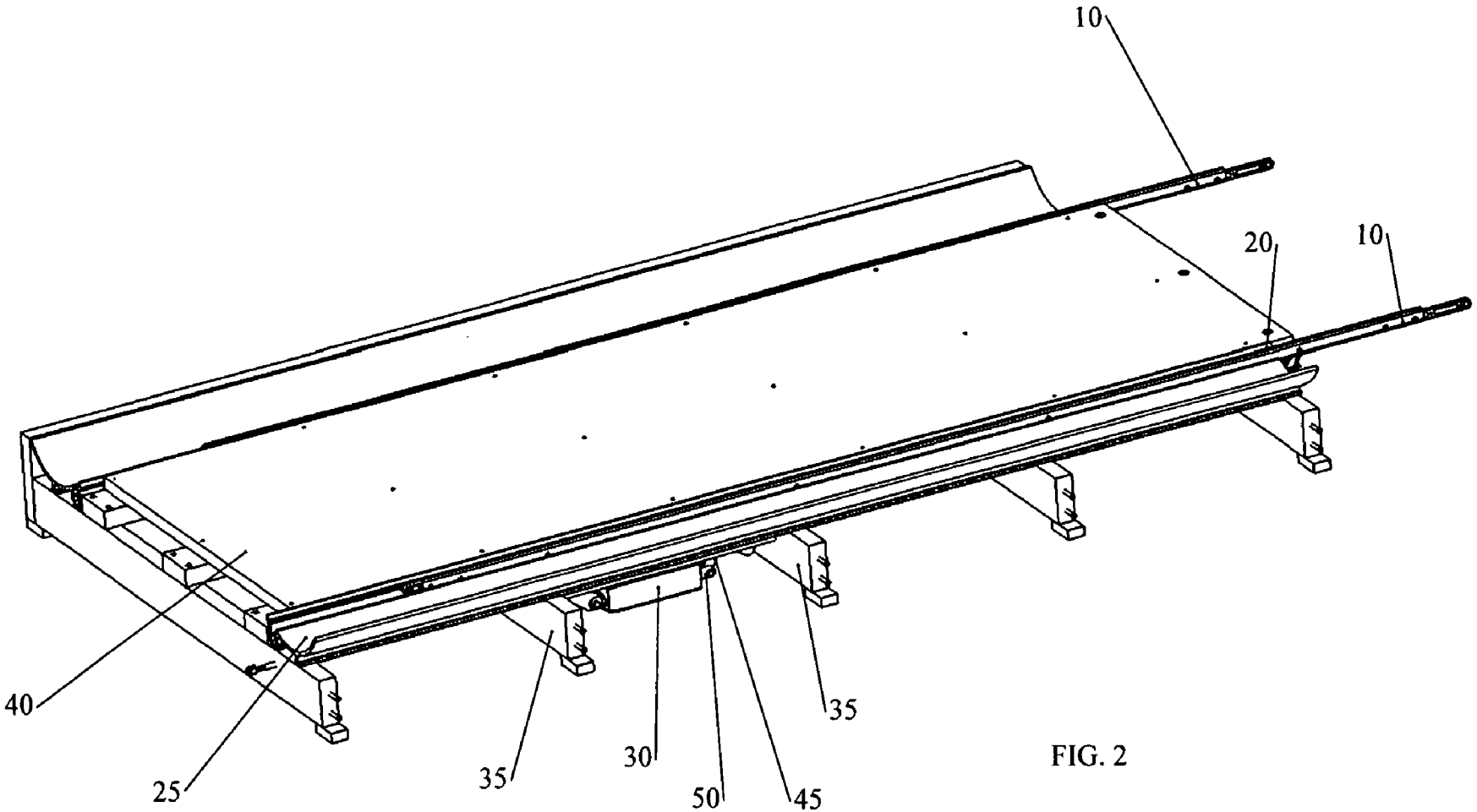
FIG. 2 shows a perspective view of the bumper system in a retracted position in accordance with one aspect of the invention.

FIG. 2 shows a perspective view of the bumper system in a retracted position in accordance with one aspect of the invention. As shown from this view, the bumper rails 10 are seated within the respective trough 20, on each inner side of the gutters 25. Although not shown in this view, as the actuator 30 is decoupled from the bumper rails 10 and more specifically decoupled from the bumper arms 15, with the bumper rails are lowered due to the force of gravity. In implementation, the speed of retraction of the bumper rails 15 can be controlled by a bracket 45 coupled to an actuator arm (extending and retracting arm) 50 of the actuator 30. For example, as the bracket 45 is lowered (or raised) by the actuator 30, it will also allow the one or more bracket arms 15 (See, FIGS. 3 and 4) to be lowered in a controlled manner, i.e., not faster than the movement of the bracket 45.

In one configuration, the gutters 25 (e.g., gutter assembly) contain cutouts for the components required for both the electrical (automated) and manual activation of the bumper rails without requiring the replacement of the gutter assemblies during a conversion from manual to electric or electric to manual. That is, the bumper system of the present invention can be a kit that is retrofitted onto existing bumper assemblies or existing bowling lanes that do not have a bumper assemblies (but which are also retrofitted after operation of the bowling lanes).

Figure 3:
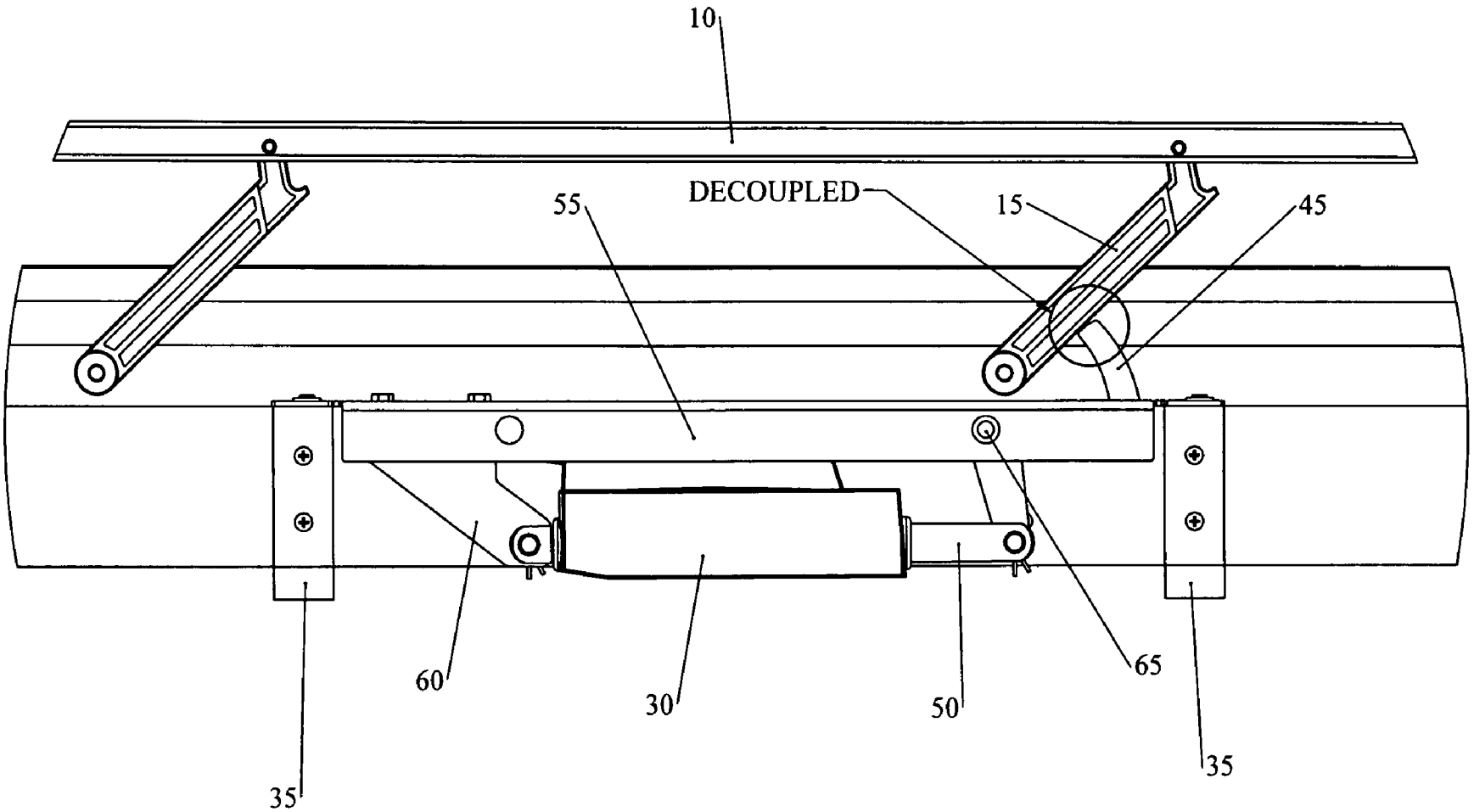
FIG. 3 shows an enlarged view of FIG. 1.

FIG. 3 shows an enlarged view of FIG. 1. As shown, the actuator 30 is mounted to a bracket 55 extending between the stringers 35. At one end, the actuator 30 is mounted by a bracket 60 to the bracket 55. At the opposing end, the actuator 30 includes an extending and retracting arm 50, which is coupled to the bracket 45. In the view shown, the extending and retracting arm 50 is in the extended position.

In one embodiment, the bracket 45 is a "z" shaped bracket, although other designs are also contemplated by the invention. The bracket 45 is pivotally connected to the bracket 55 via a shaft 65. The bracket 45 also extends through a slot (FIG. 5) of the trough 20 to make contact with respective bumper arms 15. The bracket 45, though, is decoupled from the bracket arm 15; in other words, the bracket 45 only makes physical contact with the bumper arm 15, without being fastener thereto or connected (mounted) in any manner. In one design, the bracket 45 is of slightly smaller thickness than that of the bumper arm 15 to ensure that the bracket 45 remains in contact with the bumper arm 15 during its operation. It should be understood by those of skill in the art that another bracket 45 is positioned on the other side of the bowling lane 40, in preferably a mirrored arrangement. (See, FIG. 5)

As the bracket 45 is not connected to the bumper arm 15 (and only makes physical contact), in the case that an object becomes wedged or caught under the bumper rails 10 as they are being retracted, the actuator 30 will not force the bumper rails into the retracted position. In fact, due to the decoupled design, only the weight of the bumper rail 10 (and bumper arm 15), itself, will exert any force on the object. Depending on the application of the bumper system, the weight of the bumper rails and bumper arms can range from about 10 lbs. to 30 lbs. This is compared to a force applied by the actuator 30, which would exceed such a force applied by the weight itself.

Although added safety is covered by the mechanical decoupling of the actuator 30 from the bumper rails 10 and more specifically the bumper arms 15, other back-up safety mechanisms are also provided by the present invention. For example, an E-stop type of mushroom mechanism can also be used with the bumper system. In addition, software and opto-sensor based safeguards are also contemplated by the invention. Moreover, the limit switch of the actuator can also act as a safety mechanism.

Figure 4:
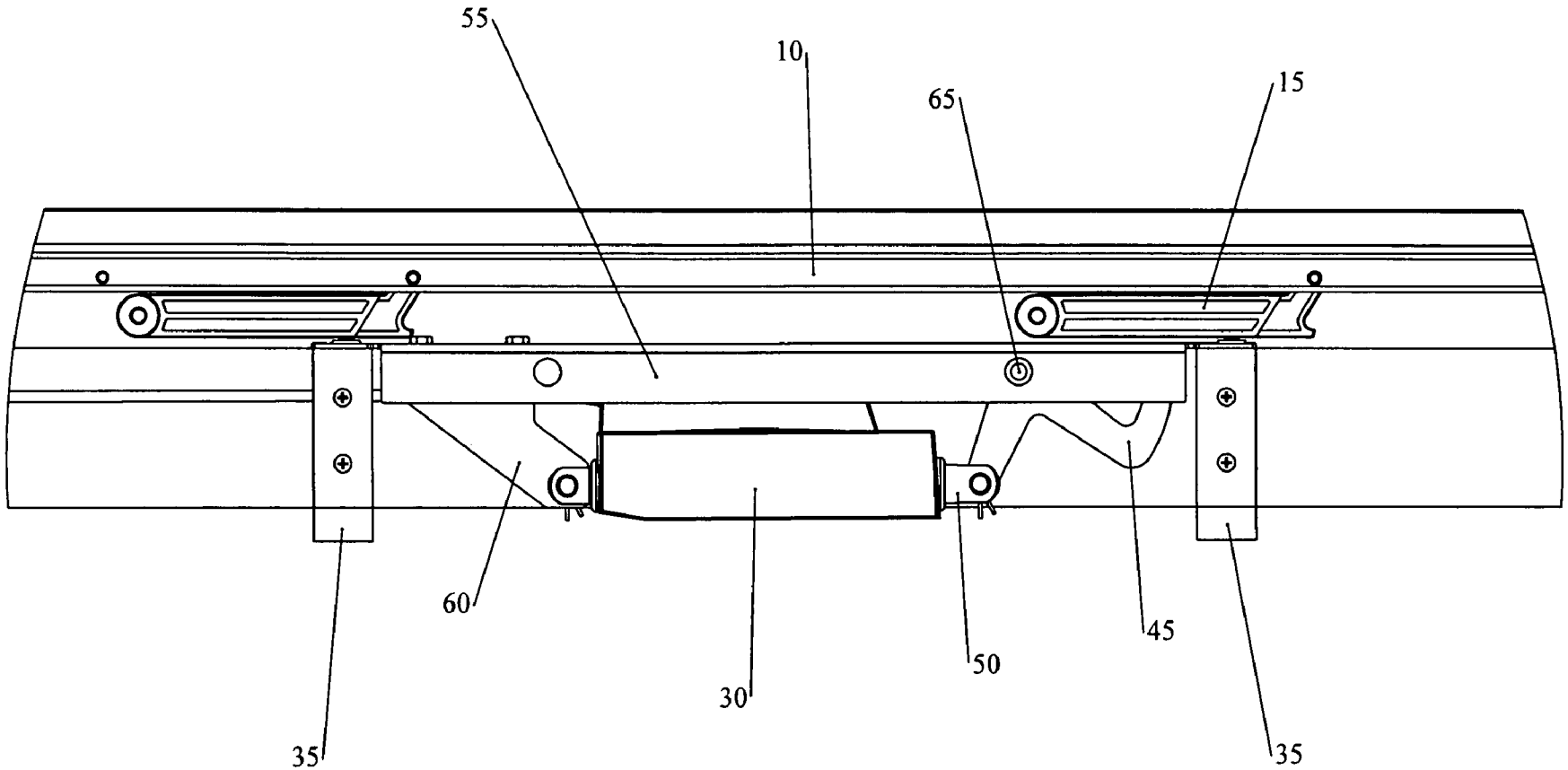
FIG. 4 shows an enlarged view of FIG. 2.

FIG. 4 shows an enlarged view of FIG. 2. As shown, the extending and retracting arm 50 is in the retracted position. As the extending and retracting arm 50 is in the retracted position, the bracket 45 is also in a lowered position, as well as the bumper rails 10 and bumper arms 15. Also, as clearly shown in this view, the bumper rails 10 and bumper arms 15, in the retracted position, are positioned or seated within the trough 20, parallel to one another.

Figure 5:
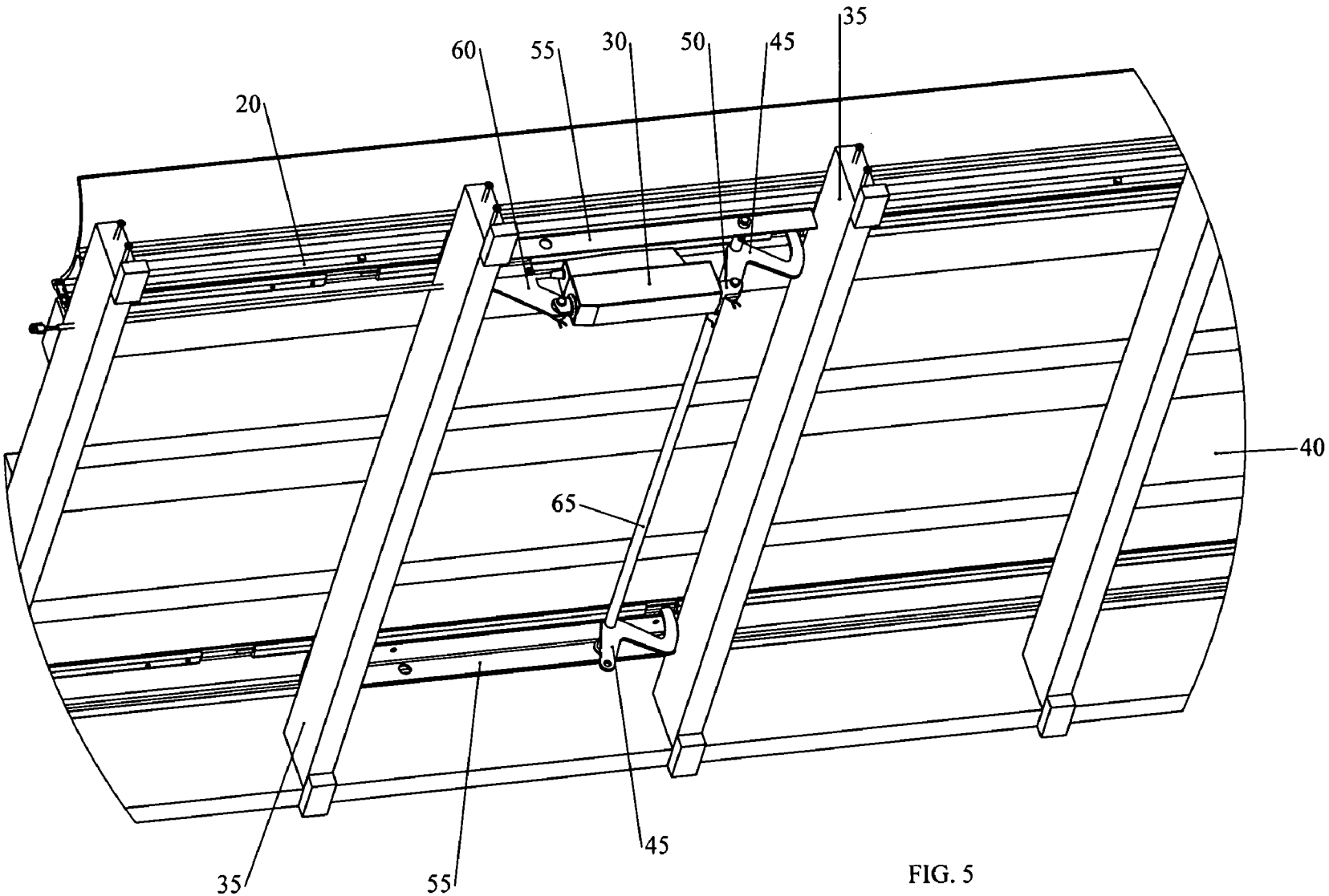
FIG. 5 shows an underside perspective view of the bumper system in accordance with the invention.

FIG. 5 shows an underside perspective view of the bumper system in accordance with the invention. As shown in this view, the bumper system 5 includes two brackets 45 on opposing sides of the bowling lane 40. The two brackets 45 are coupled to the shaft 65, which extends to opposing brackets 55. The shaft 65 is designed to be rotatable within the brackets 55 and, as each bracket 45 is coupled to the shaft, the brackets 45 operate in unison upon rotation of the shaft 65. As should be understood, the actuation of the actuator 30 will extend or retract the extending and retracting arm 50 which, in turn, will move the bracket 45, closest to the actuator 30. As both brackets 45 are coupled to the shaft 65, the movement of the bracket closest to the actuator 30 will also move the further bracket, via the shaft 65.

The underside view of the bumper system also shows slot 70 in the trough 20, in which the brackets 45 extend through when in at least the extended or upright position. As further shown in FIG. 5, several slots 70 can be placed within the trough 20. This allows the bumper system 5 to be retrofitted to many different locations under the lane 40.

Figure 6:
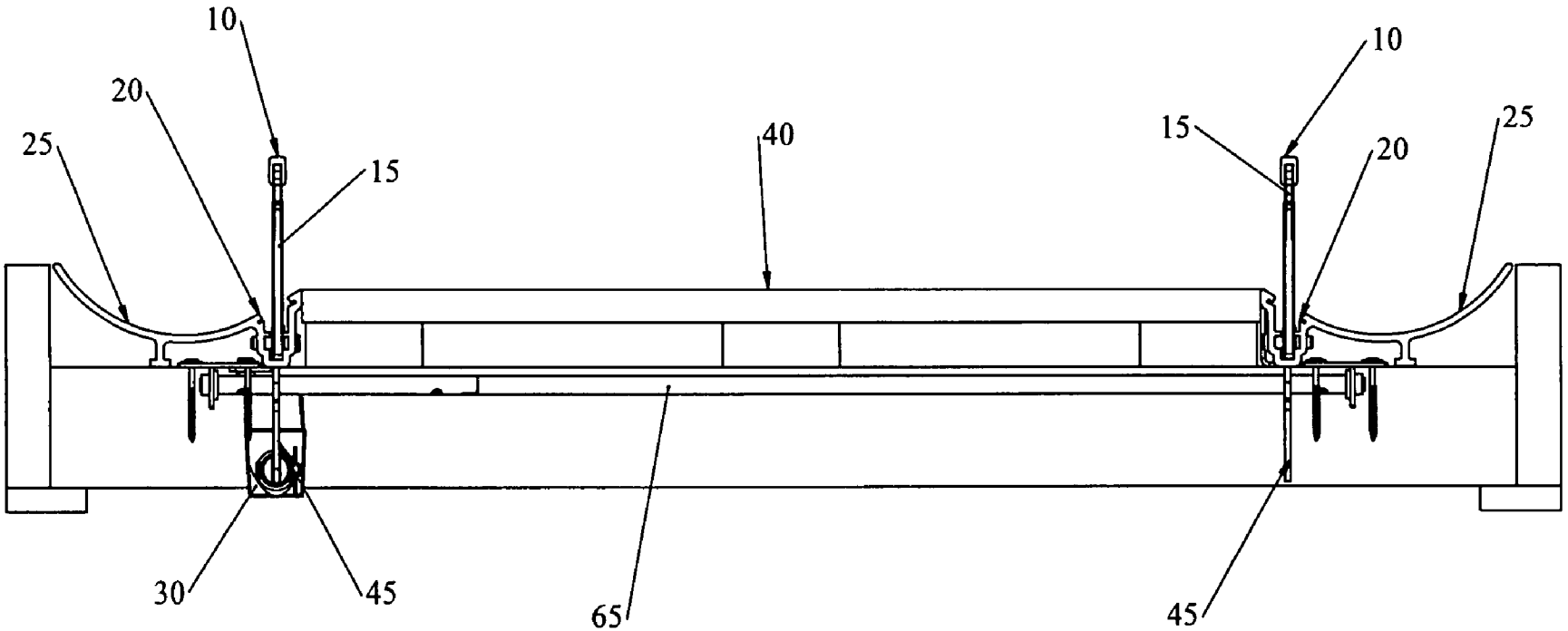
FIG. 6 shows a cutaway view of the bumper system and bowling lane in accordance with the invention.

FIG. 6 shows a cutaway view of the bumper system and bowling lane in accordance with the invention. In this view, the bumper system 5 is in an extended position. As shown clearly, the bumper rails 10 and bumper arms 15 extend from the troughs 20, on an inner portion of the gutters 25. Under one trough is the actuator 30 which is coupled to the bracket 45. The bracket 45 makes physical contact with one bumper arm 15 to position the bumper rails 10 in the upright or extended position. The shaft 65 extends across the width of the lane 40 and is coupled to the opposing bracket 45.

It should be understood by those of skill in the art that the actuator 30 can also be positioned in other locations. In fact, it is contemplated that the extending and retracting arm 50 of the actuator 30 can be coupled to another bracket coupled anywhere along to the shaft 65. In this implementation, the shaft will rotate as the actuator moves the bracket. At the shaft 65 rotates, both brackets 45 will also move, making contact with the bumper arms 15, when the extending and retracting arm 50 is in the extended position.

Figure 7:
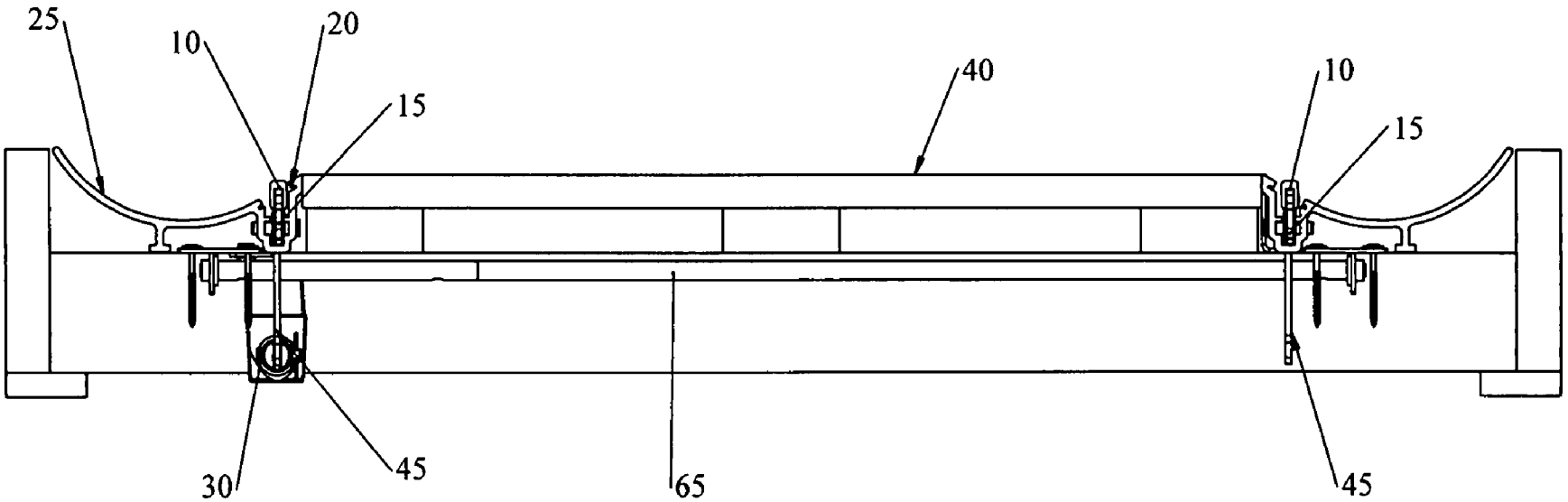
FIG. 7 shows a cutaway view of the bumper system and bowling lane in accordance with the invention.

As the actuator 30 is underneath the gutters 25, easy access is obtainable. Also, due to the configuration of the bumper system 5, existing bowling lanes can easily be retrofitted with the system, which can be a kit. This can include removing the existing gutters and mounting the bumper system between existing stringers of the bowling lane. The gutter system can then be retrofitted with slots and a trough to accommodate the bumper system or, alternatively, a new gutter system can be retrofitted in place of the existing the gutter system. However, there is no need to replace the lane or retrofit any portion of the bowling lane when installing the bumper system of the present invention. Also, due to the location of the actuator under the gutter assembly, the design shall require little or no maintenance of any kind FIG. 7 shows a cutaway view of the bumper system and bowling lane in accordance with the invention. In this view, the bumper system 5 is in a retracted position. As shown clearly, the bumper rails 10 and bumper arms 15 are positioned or seated within the troughs 20, on an inner portion of the gutters 25. The bumper rails 10 and bumper arms 15 are also below or at the surface of the bowling lane 40. This ensures that the bumper rails 10 and bumper arms 15 do not interfere with the bowling ball during normal bowling operations, i.e., allows the bowling ball to roll into the gutter without any interference during non-bumper bowling operations.

Figure 8:
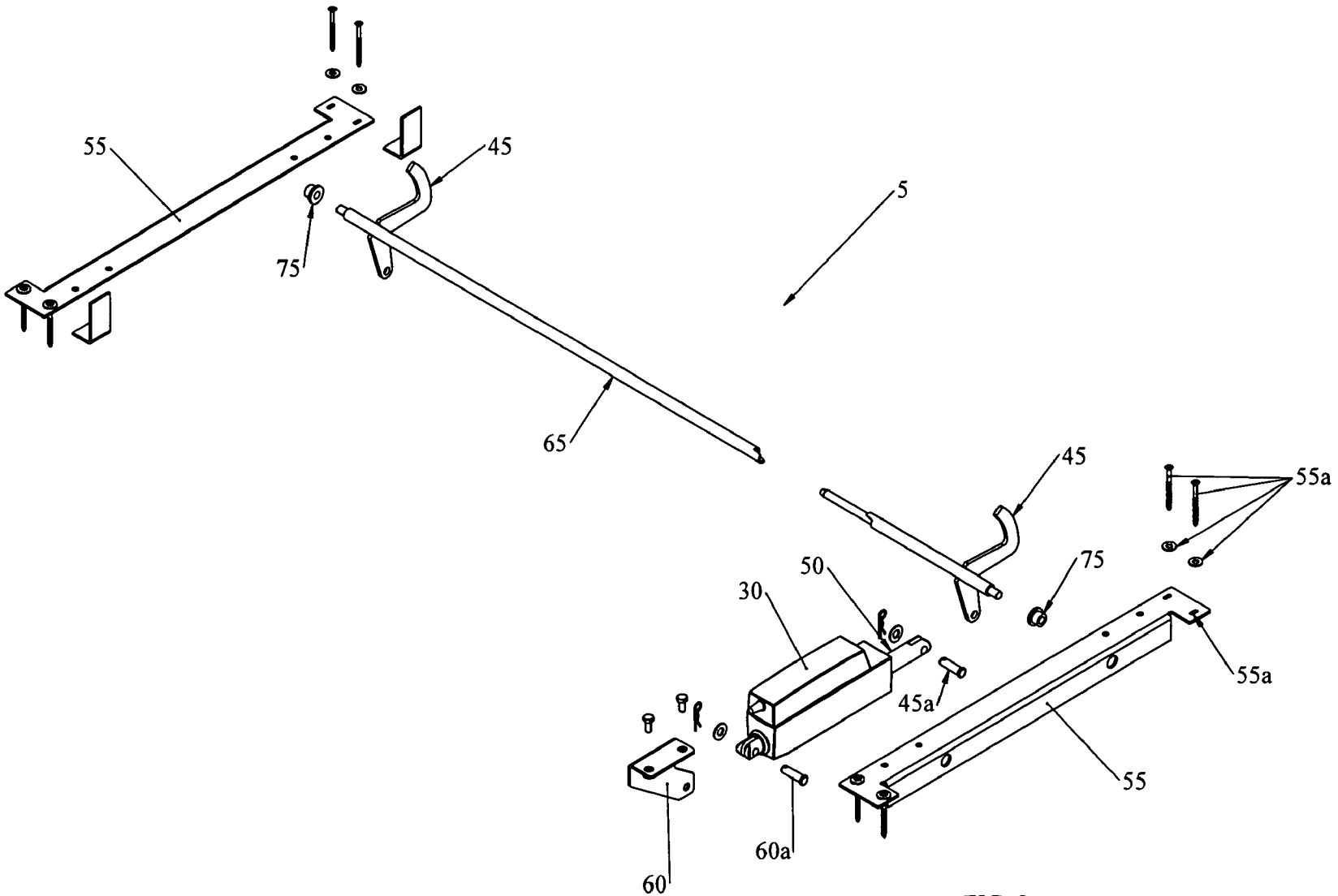
FIG. 8 shows an exploded view of the bumper system in accordance with the invention.

FIG. 8 shows an exploded view of the actuating portion of the bumper system in accordance with the invention. As shown, the bumper system 5 includes the actuator 30 which is mounted to the bracket 60 via a pinned or other type of known fastening connection 60*a*. At an opposing end (with relation to the bracket 60), the actuator 30 has an extending and retracting arm 50. The extending and retracting arm 50 is coupled or attached to the bracket 45 via a pinned mechanism 45*a*. As shown, the brackets 45 do not have any mechanism to attach to the bumper arms, in that such attachment is not necessary since the brackets 45 are mechanically decoupled from the bumper arms.

The bracket 45 (attached to the actuator), in turn, is coupled to the shaft 65. Another bracket 45 is also coupled to the shaft 65 at a remote end from the actuator 30. The shaft 65 is coupled to the opposing brackets 55, preferably via bushings or sleeves 75 to ensure smooth operation (e.g., turning) of the shaft 65. The shaft 65 should preferably be of such size to extend across an entire width of a bowling lane. The brackets 55 include holes 55*a* such that mechanical fasteners 55*b* can fasten the brackets 55 to the underside of the bowling lanes and more preferably the stringers.

Figure 9:
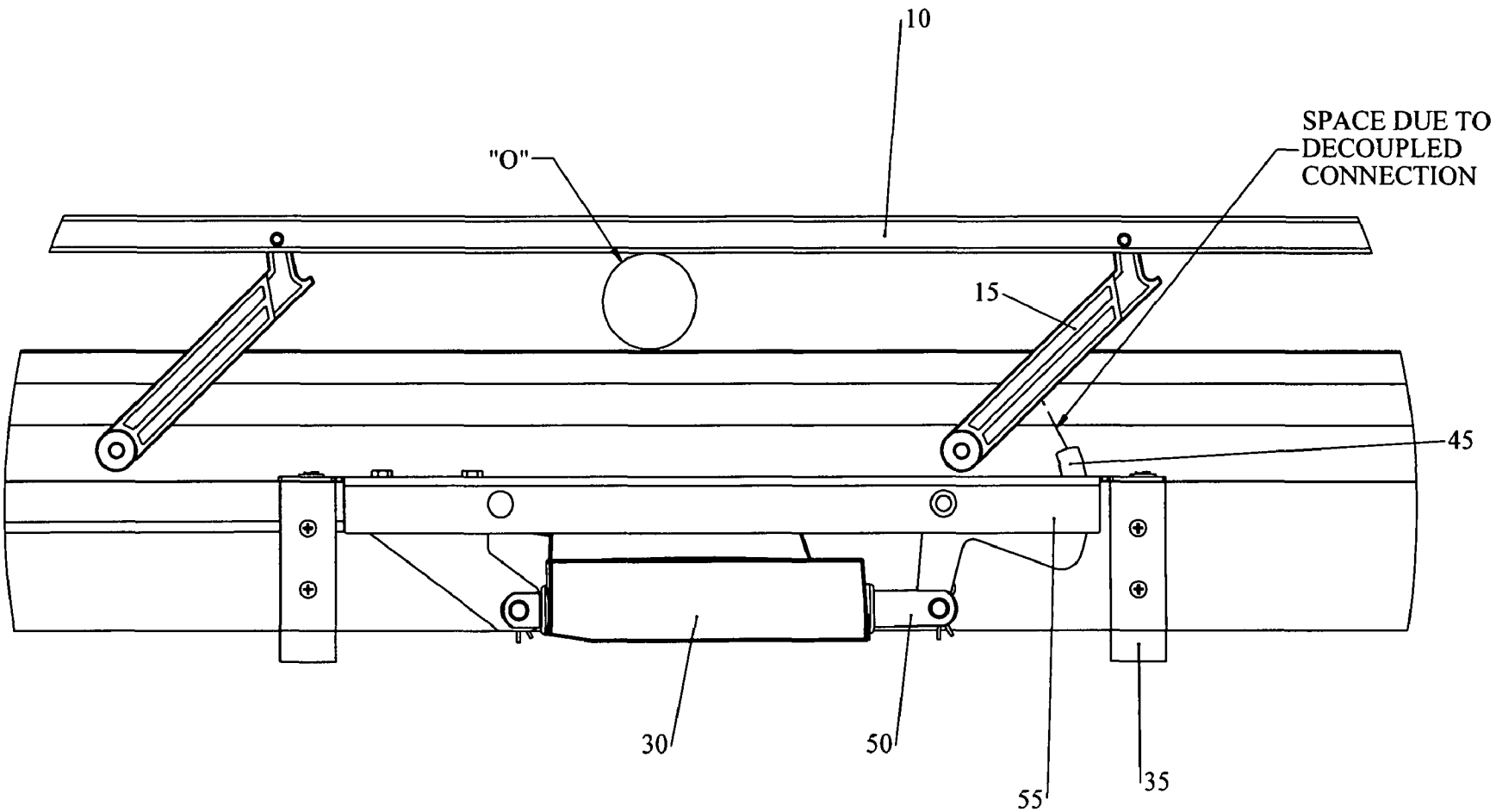
FIG. 9 shows an example of the actuator system being decoupled from the bumper rail system as the actuator system is retracted.

FIG. 9 shows an example of the actuator system being decoupled from the bumper rail system as the actuator system is retracted. More specifically, as shown in FIG. 9, the extending and retracting arm 50 of the actuator 30 is beginning to retract. As such, the bracket 45 is being lowered. However, as there is an object "O" between the bumper rail 10 and the gutter 25, the bumper rail 10 is not being forced into a retracted position. This is because the bracket 15 is not coupled (fastened) to the bumper rail 10 and, as such, freely lowers by the retraction of the extending and retracting arm 50. When the object is removed, the bumper rail 10 will lower under its own weight.

Figure 10:
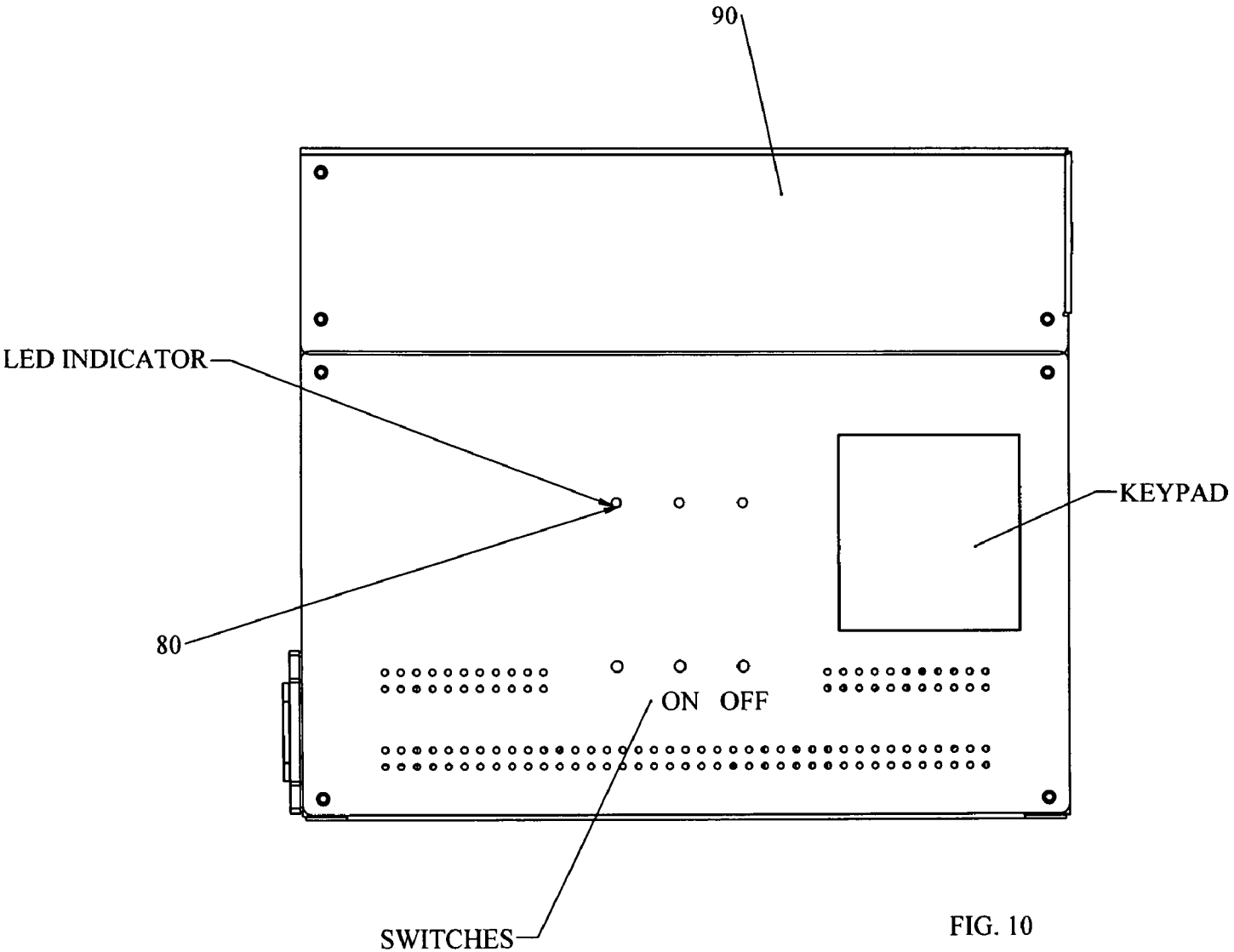
FIG. 10 shows a control system implemented in accordance with the present invention.

FIG. 10 shows a control system implemented in accordance with the present invention. The control system allows for software updates from existing scoring systems via scoring communication (LCOM) or manager's control unit (MCU) for non-scoring applications. In embodiments, normal/abnormal operation of the bumper system may be effectuated by a status LED or other indicator 80 located on a control system 90 of the present invention. In embodiments, the control system can be a box or board located on the pinspotter or curtain wall of the bowling lane, depending on the particular application. The control system 90 can also act as the interface between the electrical system and scoring system of the bowling lane, in addition to the control of the bumper system.

The control system 90 is configured to monitor the status of the actuator 30 to determine motor movement, e.g., whether the actuator is responding to issued commands. In the event that the bumper rail is prevented from extending, e.g., if an object is blocking the upward movement, the control system can sense an increase in current to the actuator 30 and shut down the system. As such, the control system can monitor the actuator current and suspend operation if the current is out of a predetermined range. If the actuator 30 is out of a predetermined range, an actuator error output is activated so that an external error is shown, e.g., indicators 80. In further embodiments, the actuator 30 can have an internal actuator thermal overload protection as a backup in the event of a failure of the software monitoring. It is contemplated that all error conditions detected by the actuator and software will be displayed on the control system 90.

In currently contemplated embodiments, the actuator 30 can be supplied with a 750 mm cable. In any type of cable, a disconnect can be provided to allow for removal of the actuator 30 without removing all of the cabling from the control system 90. The cable can be run from the control system 90 (mounted to the pinspotter or curtain wall) to the actuator 30. The connection between the cables can be implemented as a connector type mechanism.

For the control system 90, the connectors can be, in embodiments:

- 4×2 pin connectors or terminal strip for connection of the actuator 30;
- 1×LCOM communication plug for connection to the scoring system;
- 2×RJ45 plugs for daisy chain connection to a MCU. The MCU can be placed at a front desk and is designed, in at least one implementation, to override the scoring system;
- 2×2 pin plugs (e.g., screw type) for connection to a manual up/down switch to be installed on or at the bowling lane;
- 1× power input plug for main voltage input; and
- safety switch input.

It should be understood that the above are illustrative examples and that other connection known to those of skill in the art are also contemplated by the invention. As such, the above should not be considered limiting features of the invention.

In further embodiments, the control system includes connectors to enable input from TMS (also known as a pinspotter control). In this implementation, when the pinspotter is in standby or other non-operating mode, the bumper system of the present invention will be deactivated. Therefore, when the bowling lane is not in use, the bumper system will not be able to be activated and the bumper system will be in the retracted position. In embodiments, the bumper system will not operated under this mode even through manual input. Other inputs are also contemplated by the invention to provide the ability to stop bumper operation if no game is in progress. For example, it is contemplated that the bumper system will not respond to external bumper control switch inputs if the ball elevator of the bowling lane is not running.

In embodiments, the power supply for the control system and the actuator can be 85-260 VAC 50/60 Hz and converted to 24 VDC. The current requirements can be, for example, 3.2 A at 24 VDC for the electric version of the control box, and 6 A at 12 VDC for a pneumatic version.

In embodiments, the actuator can have a control board (control system) external to the TMS control chassis that takes commands from the scoring system, current TMS chassis, MCU, other scoring systems and/or buttons to raise and lower the bumper rails. Also, the control system 90 can incorporate the bumper control functionality of the current control systems for known bumper systems. For example, the bumper system of the present invention can be configured to:

- respond to LCOM (which is a lane communication with QubicaAMF scoring systems;
- function with keybump keypad (A). This allows the keypad external to the control system to communicate independently of the control system.
- function with commands from MCU (both extended protected protocol and keypad protocol); and
- have 2 color LED display depicting UP/DOWN position for the actuator.

The control system can also be configured to allow bumper system control (activation and deactivation) via lane number selection by either dip switches or serial number based keybump (MCU) controller. This would allow the activation of the bumper system via either dip switches assigned to each or a plurality of bumper systems, as well as through an assignment of lanes via a serial number. In this manner, the bumper system of the present invention can be controlled by hardware or software control. For example, in embodiments, if the dip switches are set to zero (0) then it can be possible to use lane number stored in EEPROM by the keypad to control the bumper system of the present invention. If there is no lane number in the EEPROM, the control system can signal a fault.

While the invention has been described in terms of exemplary embodiments, those skilled in the art will recognize that the invention can be practiced with modifications and in the spirit and scope of the appended claims.

It is claimed:

1. A bowling bumper system comprising an actuator configured to contact and move a bumper rail between a raised position and a lowered position, the actuator having a first bracket arm which is pivotable mounted to a bracket and which contacts a portion of the bumper rail and which is configured to be decouplable from the portion when placing the bumper rail into the lowered position, and a second bracket in contact with a bumper arm of a respective bumper rail, the first and second brackets operating in unison via a connection to a shaft extending a width of a bowling lane.

2. A bowling bumper system comprising an actuator configured to contact and move a bumper rail between a raised position and a lowered position, the actuator having a first bracket arm which is pivotable mounted to a bracket and which contacts a portion of the bumper rail and which is configured to be decouplable from the portion when placing the bumper rail into the lowered position, and a trough for accommodating the bumper rail and the portion of the bumper rail, the trough having at least one slot for accommodating a bracket extending from the actuator and contacting the bumper arm in a decoupled manner.

3. A method of installing or retrofitting a bumper system, comprising:

removing a gutter system or portion thereof;

mounting an actuator between two stringers of a bowling lane substantially in a location under where the gutter system was removed;

extending a first bracket which is mounted to an extending and retracting arm of the actuator through a first slot on a first side of the bowling lane;

placing a second bracket through a second slot on an opposing side of the bowling lane;

making a connection between the first bracket and the second bracket via a shaft extending under the bowling lane;

aligning the first bracket and the second bracket with a first arm and a second arm, respectively, of bumper rails such that the first bracket and the second bracket make physical contact with the first arm and the second arm, respectively; and installing the gutter system or the portion thereof.

4. A bowling bumper system, comprising:

an actuator having an extending and retracting arm;

a shaft extending on an underside of a bowling lane between gutters;

a first bracket coupled to the extending and retracting arm and to the shaft at a first side; and a second bracket coupled to the shaft on a second side, and which is moveable when the extending and retracting arm moves the first bracket.

5. The bumper system of claim 4, wherein the bumper system is fitted into a preexisting bowling lane.

6. The bumper system of claim 4, wherein the actuator is mounted between stringers below the bowling lane.

7. The bumper system of claim 4, wherein the first bracket and the second bracket are in contact with respective bumper arms on opposing sides of the bowling lane.

8. The bumper system of claim 4, wherein the first bracket and the second bracket are both decouplable from the bumper arm.

9. The bumper system of claim 4, further comprising a control system for monitoring and controlling operations of the actuator.

10. The bumper system of claim 4, further comprising a limit switch to control a limit of extension and retraction of the actuator.

11. The bumper system of claim 4, wherein the bumper rail and the bumper arm are below or at a surface of a bowling lane in the retracted position.

12. The bumper system of claim 4, wherein the actuator includes an internal actuator thermal overload protection system.

* * * * *